US008851665B2

(12) United States Patent
Okamoto

(10) Patent No.: US 8,851,665 B2
(45) Date of Patent: Oct. 7, 2014

(54) RECORDING APPARATUS

(75) Inventor: Katsumi Okamoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 146 days.

(21) Appl. No.: 13/592,110

(22) Filed: Aug. 22, 2012

(65) Prior Publication Data

US 2013/0050382 A1 Feb. 28, 2013

(30) Foreign Application Priority Data

Aug. 26, 2011 (JP) ..... 2011-184952

(51) Int. Cl.
*B41J 29/38* (2006.01)
*B41J 29/02* (2006.01)
*B41J 29/377* (2006.01)

(52) U.S. Cl.
CPC ..... *B41J 29/026* (2013.01); *B41J 29/377* (2013.01)
USPC ..... 347/108

(58) Field of Classification Search
CPC ..... B41J 29/13; B41J 29/026
USPC ..... 347/108
See application file for complete search history.

(56) References Cited

U.S. PATENT DOCUMENTS 8,256,762 B2 * 9/2012 Blair et al. ..... 271/126

FOREIGN PATENT DOCUMENTS

JP 2004-026438 1/2004
JP 2008224803 A * 9/2008

OTHER PUBLICATIONS

Sakanashi, Yasuhiro, Image Forming Apparatus, JP 2008-224803, Sep. 25, 2008, http://dossier1.ipdl.inpit.go.jp/AIPN/odse_call_transl.html, pp. 1-12.*
Kodera, Shinichi, Paper Supply Apparatus for Use in Image Forming Device, JP 2008-268697, Nov. 6, 2008, http://dossier1.ipdl.inpit.go.jp/AIPN/odse_call_transl.html, pp. 1-15.*

* cited by examiner

*Primary Examiner* — Shelby Fidler
*Assistant Examiner* — Tracey McMillion
(74) *Attorney, Agent, or Firm* — Workman Nydegger

(57) ABSTRACT

There is provided a recording apparatus including an apparatus main body provided with a recording unit which performs recording on a recording medium, an extension unit provided with a containing unit of the recording medium, which is detachably attached to a lower portion of the apparatus main body on a side of a weight direction of the apparatus main body, main body legs which are provided on the lower portion of the apparatus main body and are in contact with a placement surface when the apparatus main body is placed on the placement surface, and gap forming members which are provided in the extension unit, have higher rigidity exhibiting less compressional deformation as compared with the main body legs, and form a gap between the lower portion of the apparatus main body and the extension unit while being in contact with the lower portion of the apparatus main body.

4 Claims, 6 Drawing Sheets

RECORDING APPARATUS

BACKGROUND

1. Technical Field

The present invention relates to a recording apparatus, and particularly to a recording apparatus with an apparatus main body to which an extension unit can be attached.

2. Related Art

In the related art, recording apparatuses, each of which is provided with a sheet cassette containing stacked sheets as an example of a recording medium and a recording unit causing a liquid ejecting head, for example, to eject liquid onto the sheet sent from the sheet cassette and transported along a transport path to record images including characters and figures has been put into practical use.

There are some such recording apparatuses to which an extension unit (optional unit), such as an extension case configured as a separate unit from an apparatus main body, can be attached to and detached from the apparatus main body. For example, JP-A-2004-26438 discloses as the extension unit a unit which is detachably attached to a lower portion positioned on the side of the weight direction of the apparatus main body, and sends the sheet contained therein to the transport path in the apparatus main body.

In addition, the recording apparatus includes main body legs which are provided on the lower surface of the lower portion of the apparatus main body so as to be in contact with a placement surface when placed alone on the placement surface without the extension unit attached thereto. The main body legs are typically formed with an elastic material (rubber or elastomer, for example) in order to alleviate impact due to the contact with the placement surface when the apparatus main body is placed.

Incidentally, according to the recording apparatus, a temperature in the apparatus rises accompanying with heat generation in the recording unit during recording processing on the recording medium, and images cannot be correctly recorded in some cases due to a phenomenon in which an amount of liquid to be ejected from the liquid ejecting head varies due to the temperature rise. Accordingly, it is necessary to cool (air-cool) the recording apparatus by causing air (external air) to flow into the apparatus from the lower portion of the apparatus (apparatus main body) and discharging air warmed in the apparatus to the outside of the apparatus.

Thus, according to the recording apparatus, the apparatus main body is formed such that the main body legs form a gap between the lower surface of the lower portion and the placement surface in a state where the apparatus main body is placed on the placement surface. Air (external air) flows into the lower surface of the lower portion via the gap, and the external air flows from the lower portion into the apparatus through the gap formed in a case body of the apparatus main body, for example, during rising of the air warmed in the apparatus.

On the other hand, the main body legs are in contact with an upper surface of an upper portion, which is positioned on the side of a direction opposite to the weight direction, of the extension unit instead of the placement surface when the extension unit is attached to the lower portion of the apparatus main body. On this occasion, the main body legs form a gap between the upper surface of the upper portion of the extension unit and the lower surface of the lower portion of the apparatus main body.

However, although the main body legs, made of an elastic material, initially form a predetermined gap, the gap changes over time due to compression, and the deformation amount (crush amount) gradually increases, if the main body legs are in contact with the upper surface of the upper portion of the extension unit for a long time. As a result, the gap between the upper surface of the upper portion of the extension unit and the lower surface of the lower portion of the apparatus main body becomes narrower than that in the initial state, and there is a problem in that a flow amount of the air flowing into the apparatus main body from the lower portion becomes smaller. In addition, there is also a problem in that a length of the transport path for the sheet sent from the extension unit becomes shorter as the gap between the apparatus main body and the extension unit becomes narrower and variations in the transport conditions results in unstable transport.

SUMMARY

An advantage of some aspects of the invention is to provide a recording apparatus in which a gap can be stably formed between an apparatus main body and an extension unit in a state where the extension unit is attached to the apparatus main body.

According to an aspect of the invention, there is provided a recording apparatus including: an apparatus main body provided with a recording unit which performs recording on a recording medium; an extension unit provided with a containing unit of the recording medium, which is detachably attached to a lower portion of the apparatus main body on a side of a weight direction; main body legs which are provided on the lower portion of the apparatus main body and are in contact with a placement surface when the apparatus main body is placed on the placement surface; and gap forming members which are provided in the extension unit, have higher rigidity exhibiting less compressional deformation as compared with the main body legs, and form a gap between the lower portion of the apparatus main body and the extension unit while being in contact with the lower portion of the apparatus main body.

With such a configuration, it is possible to stably form a gap, for which gap forming members with high rigidity suppress the decrease in clearance due to change over time, between the lower portion of the apparatus main body and the extension unit when the extension unit is attached to the apparatus main body. Accordingly, the external air reliably flows into the apparatus from the lower portion of the apparatus main body.

In the recording apparatus, the main body legs of the apparatus main body may be in a non-contact state with respect to the extension unit.

With such a configuration, it is possible to reliably maintain a state where the main body legs are not in contact with the extension unit with the gap forming members and thereby to suppress crush due to compression of the main body legs. Accordingly, decrease in the gap between the lower portion and the placement portion is suppressed in the state where the extension unit is detached later and the apparatus main body is placed on the placement surface.

In the recording apparatus, the apparatus main body may include ducts formed at the lower portion so as to communicate with inside of the apparatus main body.

With such a configuration, it is possible to effectively suppress the temperature rise in the recording unit, for example, by the external air flowing into the apparatus main body from the lower portion.

In the recording apparatus, the extension unit may be provided with a duct including one opening at a facing part facing the lower portion of the apparatus main body and the other opening at a part other than the facing part.

With such a configuration, it is possible to cause the external air to flow into the lower portion of the apparatus main body from the side of the extension unit in a state where the extension unit is attached to the apparatus main body and to thereby increase the total amount of the external air flowing into the lower portion of the apparatus main body.

In the recording apparatus, a gap may be formed between the lower portion of the apparatus main body and the extension unit around the entire circumference of the lower portion of the apparatus main body.

With such a configuration, the total amount of the external air flowing into the lower portion of the apparatus main body increases, and therefore, the external air reliably flows into the apparatus main body from the lower portion of the apparatus main body.

In the recording apparatus, the gap forming members may be provided at positions in horizontal directions from the main body legs or in the vicinities thereof when the extension unit is attached to the apparatus main body.

With such a configuration, it is possible to reliably maintain a state where the main body legs are not in contact with the extension unit by the gap forming members and to thereby suppress crush of the main body legs due to compression. Accordingly, decrease in the gap between a bottom surface portion and the placement surface is suppressed in the state where the extension unit is detached later and the apparatus main body is placed on the placement surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
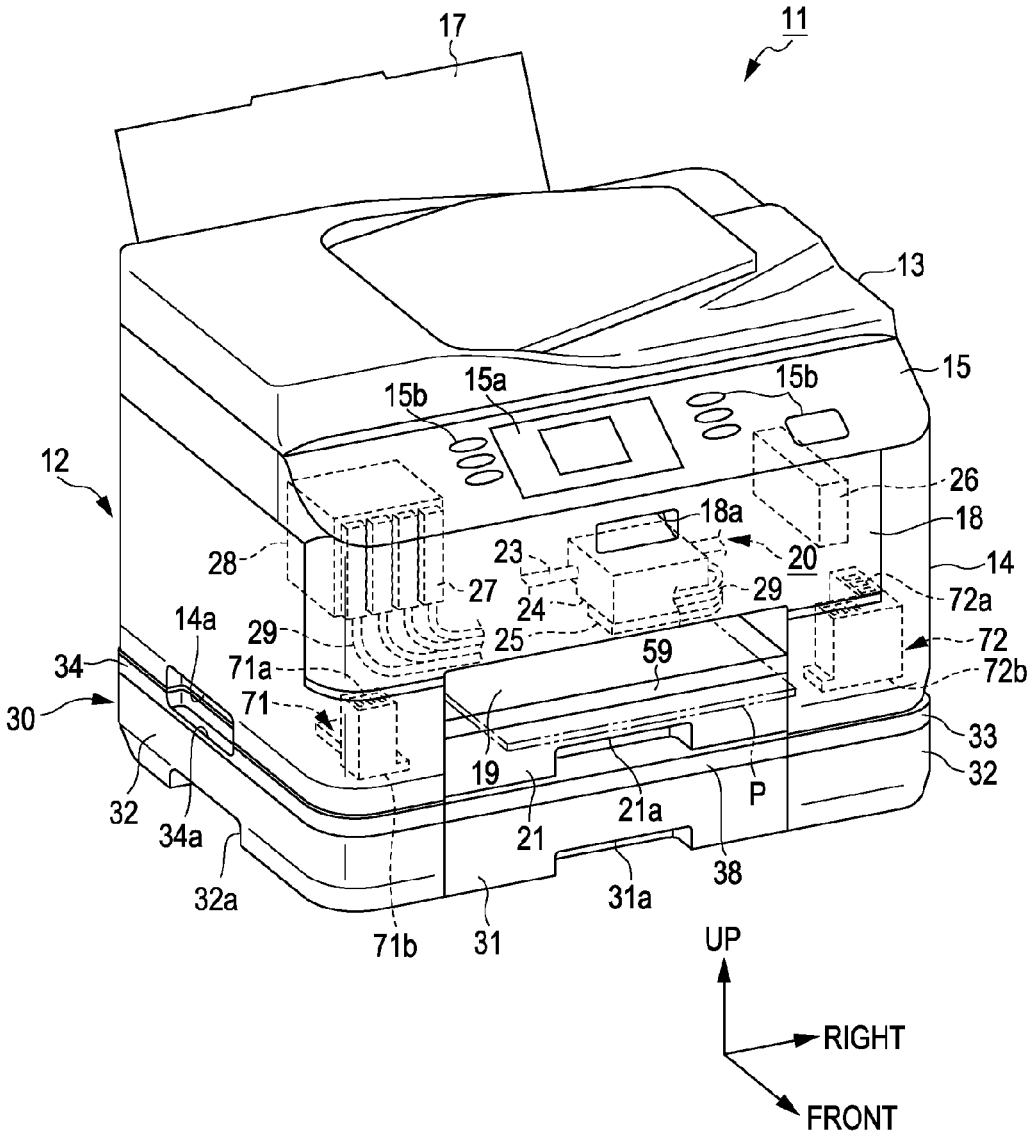
FIG. 1 is a perspective view of a recording apparatus according to an embodiment of the invention when viewed from a front and diagonally left upper position.

Description will be given of recording apparatus, which is a multifunction machine integrally including an image reading device for reading images and a liquid ejecting device provided with a liquid ejecting head for ejecting liquid, which ejects the liquid onto a recording medium to record images, according to an embodiment of the invention with reference to the drawings. To simplify the following description, the weight direction in a vertical direction will be referred to as a downward direction, and a direction opposite to the weight direction will be referred to as an upward direction, as shown in FIG. 1. In addition, a transport direction, which intersects the upper and downward directions, in which a sheet P as a kind of recording medium is transported during image recording, will be referred to as a forward direction, and a direction opposite to the transport direction will be referred to as a backward direction. Furthermore, directions, which intersect both the vertical direction and the transport direction, in which a liquid ejecting head 25 reciprocates, will be referred to as a right direction and a left direction when viewed from the forward direction.

As shown in FIG. 1, a recording apparatus 11 includes an apparatus main body 12 and an extension unit 30 as an extension case for the apparatus main body 12 of the recording apparatus 11. The apparatus main body 12 is provided with a recording unit 20 which functions as an ink-jet printer (also simply referred to as a "printer") as an example of the liquid ejecting device and an image reading unit 13 which functions as an image reading device disposed in the upper portion of the apparatus main body 12. In addition, the apparatus main body 12 includes the recording unit 20 in a device case 14 thereof as a case body configured by a plurality of members, and is integrally formed with the image reading unit 13.

On the upper side of a front surface of the device case 14, an operation panel 15 is arranged for operating the recording unit 20 and the image reading unit 13. The operation panel 15 is provided with a display unit 15*a* (a liquid crystal display, for example) for displaying a menu screen and the like and an operation unit 15*b* provided on both horizontal sides of the display unit 15*a*.

In the device case 14, a front cover 18 is attached to the lower side of the operation panel 15 so as to be freely opened and closed. The front cover is opened to a side near a user via a hinge on the lower side of the front cover, which is not shown in the drawing. In addition, the front cover 18 is provided with a gripped portion 18*a* with a concaved shape, which the user holds with a hand for opening or closing the front cover 18. In addition, a sheet discharge port 19 for discharging the sheet P discharged from the recording unit 20 to the outside of the apparatus main body 12 opens on the lower side of the front cover 18 of the device case 14. In addition, discharged sheet table 59 is arranged on the lower side of the sheet discharge port 19.

The recording unit 20 which functions as a printer ejects liquid onto the sheet P and records images. That is, a guide shaft 23 extending in the horizontal direction (this will be also referred to as a "main scanning direction") is installed in the device case 14. In addition, a carriage 24 is supported by the guide shaft 23 in a movable state along the main scanning direction. The carriage 24 is driven by a carriage motor which is not shown in the drawing and reciprocates in the main scanning direction. Moreover, a liquid ejecting head 25 for ejecting ink as an example of the liquid onto the sheet P to record (print) images is supported on the side of the lower surface of the carriage 24. In addition, a substrate unit 26 provided with a drive circuit which displaces the liquid ejecting head 25 by displacing the carriage 24 and drives the liquid ejecting head being displaced to eject the ink is disposed at a right end portion of a displacement region of the carriage 24 along the main scanning direction.

On the other hand, a plurality of (four in this embodiment) ink cartridges 27 containing ink to be supplied to the liquid ejecting head 25 are disposed at a left end portion of the displacement region of the carriage 24 along the main scanning direction. In addition, a cartridge holder 28 to which the ink cartridges 27 are detachably attached and ink supply tubes 29 for supplying ink from the side of the cartridge holder 28 to the side of the carriage 24 are provided. In addition, the ink cartridges 27 are detachable from the cartridge holder 28 in a state where the front cover 18 of the device case 14 is opened.

Furthermore, the sheet P on which recording is performed by the recording unit 20 with the above configuration is supplied from both the apparatus main body 12 and the extension unit 30 to the recording apparatus 11 via the transport path formed in the apparatus main body 12. Description will be given of a configuration of supplying the sheet P to the recording unit 20 with reference to FIGS. 1 and 2.

Figure 2:
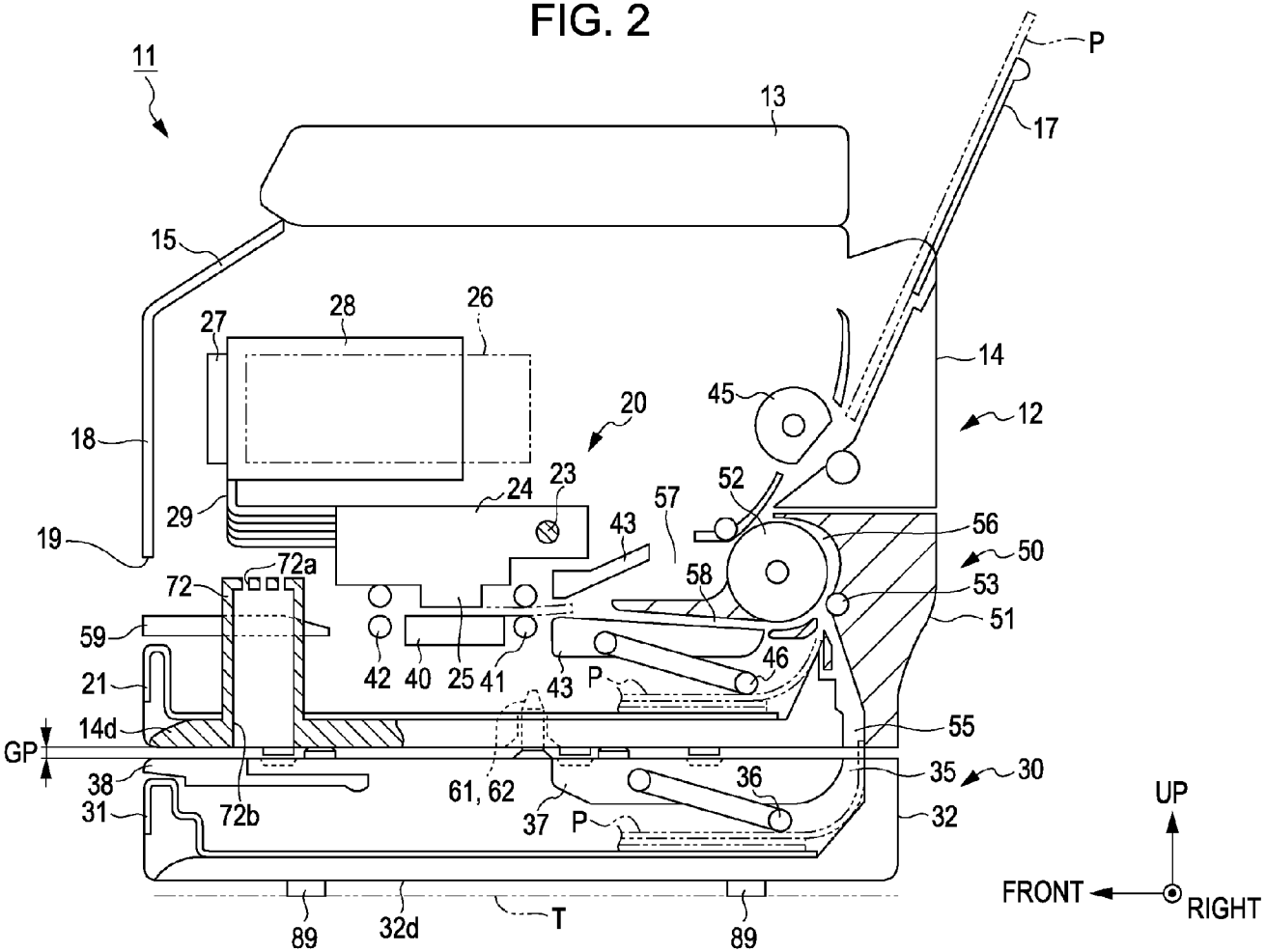
FIG. 2 is a partial cross-sectional view of a duct and a sheet transport path included in the recording apparatus according to the embodiment.

First, the apparatus main body 12 includes a sheet cassette 21 stacking and containing the sheets P provided on the lower side of the discharged sheet table 59, the stacked and contained sheets P are sent one by one from the uppermost sheet P to the transport path, then transported along the transport path, and supplied to the recording unit 20, as shown in FIGS. 1 and 2.

The sheet cassette 21 can be inserted into and pulled out from the apparatus main body 12, and includes an eave-shaped gripped portion 21*a* provided on the front surface side so as to be held with a hand of an operator for pulling the sheet cassette 21 out from the apparatus main body 12, which makes it easier to pull forward the sheet cassette 21 out from the apparatus main body 12.

In addition, the apparatus main body 12 includes a placement tray 17 for placing the sheet P provided in the back side of the device case 14, and the sheet P placed on the placement tray 17 is transported from a position in the course of the transport path, which extends from the sheet cassette 21 to the recording unit 20, along the transport path and supplied to the recording unit 20.

On the other hand, the extension unit 30 is a combination of a lower case 32 and upper cases 33, 34, and 38 and is formed in a box shape. In addition, the extension unit 30 includes a sheet cassette 31, in which sheets P are stacked and contained, as a containing unit of the sheets P provided on the lower side of the upper case 38 at the center between a pair of two left and right upper cases 33 and 34, and the uppermost one of the stacked and contained sheets P is sent to the transport path and fed to the recording unit 20. The sheet cassette 31 can be inserted into and pulled out from the extension unit 30 in the forward-backward direction and includes an eave-shaped gripped portion 31*a* provided on the side of the front surface so as to be held with a hand of the operator for pulling the sheet cassette 31 out from the extension unit 30, which makes it easier to pull forward the sheet cassette 31 out from the extension unit 30. In addition, unit legs 89 in contact with the placement surface T are attached to the lower surface of a lower portion 32*d* of the extension unit 30 (lower case 32).

The recording apparatus 11 according to this embodiment includes a reversing unit 50 provided on the back side of the device case 14 as shown in FIG. 2, and the reversing unit 50 is a main part of the transport path of the sheet P supplied to the recording unit 20. The reversing unit 50 reverses front and back sides of the sheet P, that is, reverses the surface, which is to be recorded, in the transport path in order to perform recording on both sides of the sheet P to be supplied to the recording unit 20. That is, the reversing unit 50 includes a unit frame 51 (a hatched part in the drawing) whose back surface functions with the device case 14 as a case body of the recording apparatus 11, a reversing roller 52, and a retard roller 53. The reversing roller 52 is axially supported in a rotatable manner by the unit frame 51 about a horizontal axis line based on drive force from a drive source which is not shown in the drawing to pinch and transport the sheet P with the retard roller 53 which is axially supported in a rotatable manner by the unit frame 51 about a horizontal axis line in the same manner. In addition, the retard roller 53 is a roller which allows the reversing roller 52 to transport the sheet P one by one.

In the recording apparatus 11, transport passages 55, 56, 57, and 58 are configured as the transport path, through which the sheet P is transported mainly by the reversing unit 50, in the apparatus main body 12 of the recording apparatus 11. The transport passage 55 corresponds to the transport path through which the sheet P contained in the sheet cassette 31 of the extension unit 30 is sent from the sheet cassette 31. That is, the extension unit 30 includes a sheet feeding roller 36 axially supported by a fixed frame 37, which is provided on the back upper side, so as to swing freely. The sheet P stacked and contained in the sheet cassette 31 is sent by the sheet feeding roller 36 from an opening 35 opened on the back upper side of the extension unit 30 to the transport passage 55.

The transport passage 56 is sequentially formed from the transport passage 55, and has a curved shape corresponding to an outer circumferential shape of the reversing roller 52. The transport passage 56 is the transport path through which the sheet P contained in the sheet cassette 21 of the apparatus main body 12 is sent in addition to the sheet P contained in the extension unit 30 and transported along the transport passage 55. That is, the sheet P stacked and contained in the sheet cassette 21 is sent to the transport passage 56 by the sheet feeding roller 46 axially supported by a transport passage configuring member 43, which is formed in the apparatus main body 12, so as to freely swing.

The transport passage 57 is sequentially formed from the curve-shaped transport passage 56 for sending the sheet P stacked in the placement tray 17 and transported one by one by the sheet feeding roller 45 in addition to the sheet P transported along the transport passage 56. In addition, the sheet P sent to the transport passage 57 is pinched by a sheet sending roller pair 41 axially supported in a rotatable manner by the apparatus main body 12 and transported to the recording unit 20. In addition, the sheet P with a recording surface on which recording has been completed by the recording unit 20 is pinched by sheet discharging roller pair 42 axially supported in a rotatable manner by the apparatus main body 12, and discharged from the recording unit 20 to the discharged sheet table 59 (sheet discharge port 19).

According to this embodiment, the sheet sending roller pair 41 and the sheet discharging roller pair 42 are rotated in both normal and reverse directions by a drive source which is not shown in the drawings. By such rotation, the sheet P is transported in the transport direction (the forward direction in this case) between the liquid ejecting head 25 and a supporting table 40 disposed in on the lower side thereof to support the sheet P in the recording unit 20, recording is performed on one side (front surface), and the sheet is returned to the back side to be transported along the transport passage 58.

The transport passage 58 is formed on the lower side of the transport passage 57, and the sheet P is transported from the front side to the back side when recording is performed on both front and back sides of the sheet P in the case of double-side printing, for example. That is, the sheet P transported through the transport passage 58 is sent to the transport passage 56 and moved through the curve-shaped transport passage 56 by the rotation of the reversing roller 52. By the movement through the transport passage 56, the movement direction of the sheet P is reversed from the back side to the front side, and the sheet P is in a state where the front side and the back side thereof are reversed, when sent again to the transport passage 57. As described above, the reversing unit 50 configures the transport passages 56 to 58 as a reversing passage for reversing the front and back sides of the sheet P in the transport path, which is formed in the apparatus main body 12, of the sheet P.

In the recording apparatus 11 to which the sheet P is supplied from both the apparatus main body 12 and the extension unit 30 as described above, the extension unit 30 can be attached to and detached from the apparatus main body 12. That is, according to this embodiment, the extension unit 30 is attached while stacked on the lower side of the apparatus main body, namely the side of the weight direction, by the operator displacing the apparatus main body 12 in the weight direction from the upper side of the extension unit 30, that is, by lowering the height position of the lifted apparatus main body 12 from the upper side of the extension unit 30. In addition, the extension unit 30 is detached from the apparatus main body 12 by lifting the apparatus main body 12 to the upper side, namely in the direction opposite to the weight direction in a state where the extension unit 30 is attached.

A pair of handholds is provided for the operator holding the apparatus main body 12 with the hand during the attachment and detachment operations. That is, as shown in FIG. 1, inwardly concaved spatial regions are provided as handholds on both left and right sides of the lower end portion of the device case 14 in the apparatus main body 12 and the upper left side of the upper case 34 and the upper right side of the upper case 33 in the extension unit 30.

Specifically, a handhold configuring portion 14*a* opening in both the downward direction and the left direction is provided on the left side of the lower end portion of the device case 14 in the apparatus main body 12. On the other hand, a handhold configuring portion 34*a* opening in both the upward direction and the left direction is formed on the upper left side of the left upper case 34 among the pair of left and right upper cases 33 and 34 in the extension unit 30. In addition, the handhold configuring portion 14*a* and the handhold configuring portion 34*a* are provided such that the mutual spatial regions overlap each other in the vertical direction, and the spatial regions form a sequential handhold.

A handhold configuring portion 14*b* (see FIG. 3) opening in both the downward direction and the right direction is provided on the right side of the lower end portion of the device case 14 in the apparatus main body 12. On the other hand, a handhold configuring portion 33*a* (see FIGS. 4A and 4B) opening in both the upward direction and the right direction is provided on the upper right side of the right upper case 33 in the extension unit 30. In addition, the handhold configuring portion 14*b* and the handhold configuring portion 33*a* are provided such that the mutual spatial regions overlap each other in the vertical direction, and the spatial regions configure a sequential handhold. In so doing, a pair of left and right handholds is provided in the recording apparatus 11.

In addition, the recording apparatus 11 according to this embodiment includes a handhold configuring portion 32*a* opening in both the left side and the lower side is provided on the left side of the lower end portion of the extension unit 30 as shown in FIG. 1. In addition, a handhold configuring portion 32*b* (see FIG. 4A), which opens in both the right side and the lower side, with the same shame as that of the handhold configuring portion 14*b* is provided on the right side of the lower end portion of the extension unit 30. The handhold configuring portion 32*a* and the handhold configuring portion 32*b* form spatial regions functioning as handholds for lifting the entire recording apparatus 11 while the extension unit 30 is attached to the apparatus main body 12.

Incidentally, the temperature of the recording apparatus 11 rises due to heat generation of components of the recording unit 20 when the recording unit 20 performs recording on the sheet P supplied from the sheet cassettes 21 and 31 or the placement tray 17. The air in the recording unit 20 inside the apparatus main body 12 is warmed when the liquid ejecting head 25 generates heat during an ink ejecting operation from the liquid ejecting head 25 displacing in the main scanning direction along with the displacement of the carriage 24, or when the substrate unit 26 for driving and controlling the displacement operation of the carriage 24 and the ink ejecting operation generates heat during such operations, for example.

In the recording apparatus 11 according to this embodiment, ducts through which air outside the apparatus main body 12, namely the external air is made to flow into the apparatus main body 12 as the warmed air rises and is discharged to the outside of the apparatus main body 12 are disposed. That is, a duct 71 and a duct 72 are provided at the left end portion and the right end portion, respectively, in the device case 14 of the apparatus main body 12. The ducts 71 and 72 are provided with upper openings 71*a* and 72*a*, each of which is formed with a plurality of slit-shaped openings, on the upper side and lower openings 71*b* and 72*b* on the lower side, respectively, and duct lines through which the air flows between the lower opening 71*b* and the upper opening 71*a* are formed.

That is, the lower opening 72*b* of the duct 72 communicates with a space on the lower side of the lower portion 14*d* of the device case 14 while the upper opening 72*a* communicates with a space, in which the recording unit 20 is provided, in the device case 14, as shown in FIG. 2. Although not shown in FIG. 2, the duct 71 is configured in a substantially same manner as the duct 72, and the lower opening 71*b* of the duct 71 communicates with the space on the lower side of the lower portion 14*d* of the device case 14 while the upper opening 71*a* communicates with a space, in which the recording unit 20 is provided, in the device case 14.

Incidentally, the recording apparatus 11 has a configuration in which the extension unit 30 can be attached to and detached from the apparatus main body 12 as described above. According to this embodiment, the extension unit 30 is provided with convexed portions 61 and 62 protruding upward, as shown in FIG. 2, and the convexed portions 61 and 62 are inserted and fitted into concaved portions 16*a* and 16*b* (see FIG. 3) provided as through-holes or holes with bottoms in the lower portion 14*d* of the device case 14 at parts, to which the extension unit 30 is attached, in the apparatus main body 12. By such fitting, the extension unit 30 is attached to the apparatus main body 12 while being stacked on the lower side of the apparatus main body 12, namely the side of the weight direction. In addition, a gap GP with a predetermined dimension is formed between the lower surface of the lower portion 14*d* of the apparatus main body 12 and the upper surface (more specifically, each of the upper surfaces of the upper cases 33 and 34) of the extension unit 30 in a state in which the extension unit 30 is attached to the lower side of the apparatus main body 12.

Figure 3:
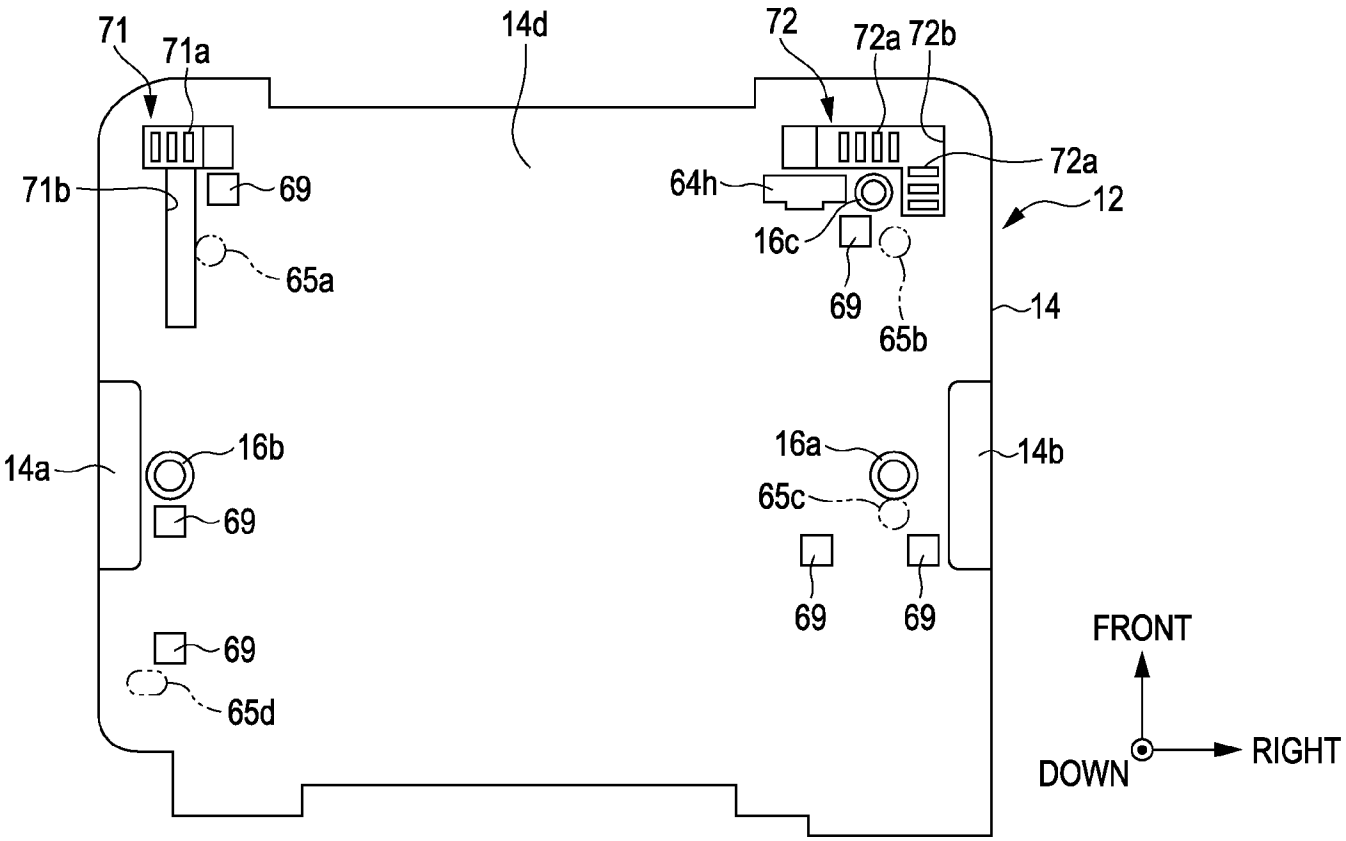
FIG. 3 is diagram schematically showing a lower portion of an apparatus main body when viewed from a lower side.
Figure 4A:
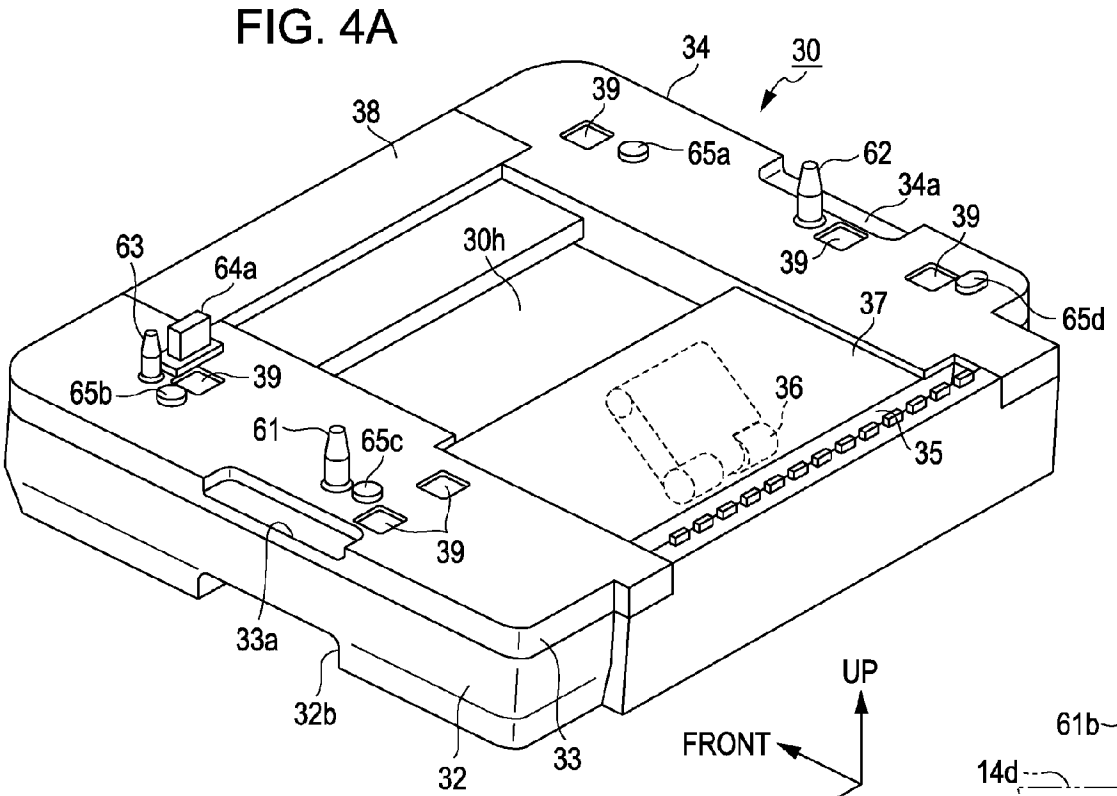
FIG. 4A is a perspective view showing a configuration of an extension unit.
Figure 4B:
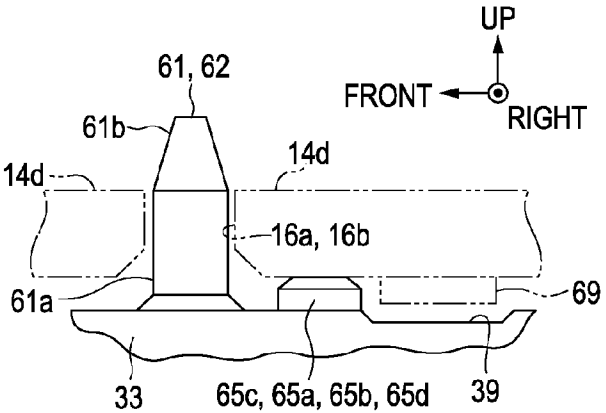
FIG. 4B is a configuration diagram showing convexed portions provided in the extension unit, contact portions in contact with the apparatus main body, and retracting portions for the apparatus main body.

Next, description will be given of an attachment configuration between the apparatus main body 12 and the extension unit 30 for forming the gap GP as described above with reference to FIGS. 3, 4A, and 4B. In FIGS. 3, 4A, and 4B, same reference numerals are given to the components described above.

As shown in FIG. 3, the lower portion 14*d*, to which the extension unit 30 is attached, in the apparatus main body 12 has a substantially rectangular shape when viewed from the lower side, and the handhold configuring portions 14*a* and 14*b* are respectively formed at both the left and right end portions at substantially center positions in the front-back direction. In addition, the concaved portion 16*b* is provided near the handhold configuring portion 14*a* on the right side thereof, and the concaved portion 16*a* is provided near the handhold configuring portion 14*b* on the left side thereof.

In addition, a plurality of (six in this case) main body legs 69 (hatched in the drawing) functioning as legs when the apparatus main body 12 is placed without the extension unit 30 attached thereto are attached to the lower surface of the lower portion 14*d*. The main body legs 69 are formed with an elastic member (elastomer or rubber, for example) with a predetermined thickness in the vertical direction, absorbs impact when the apparatus main body 12 is placed on the placement surface T by compressional deformation, and functions to allow the recording apparatus 11 (apparatus main body 12) to be stably placed on the placement surface T by frictional force.

In addition, a substantially T-shaped lower opening 71*b* of the duct 71 is provided near a front left corner of the lower portion 14*d* while a substantially L-shaped lower opening 72*b* of the duct 72 is provided near a front right corner thereof. According to this embodiment, the upper opening 71*a* is formed such that the opening region thereof overlaps the opening region of the lower opening 71*b* in the vertical direction, and the upper opening 72*a* is formed such that the opening region thereof overlaps the opening region of the lower opening 72*b* in the vertical direction.

In the recording apparatus 11 according to this embodiment, a connection terminal 64*a* (see FIG. 4A) provided in the extension unit 30 is inserted into the apparatus main body 12 for electrical continuity between the extension unit 30 and the apparatus main body 12 while the extension unit 30 is attached. The electrical continuity makes it possible to perform a sending operation of the sheet P from the sheet cassette 31 in the extension unit 30 to the transport passage 55. For this reason, an opening hole 64*h* through which the connection terminal 64*a* provided in the extension unit 30 penetrates when inserted into the apparatus main body 12 is provided near the front right corner of the lower portion 14*d* of the apparatus main body 12. Furthermore, a guide hole 16*c* into which a guide protrusion 63 (see FIG. 4A) is inserted for positioning the connection terminal 64*a* provided in the extension unit 30 is provided near the opening hole 64*h* in the lower portion 14*d*.

As shown by two-dotted lines in FIG. 3, contact members 65*a*, 65*b*, 65*c*, and 65*d* as gap forming members provided in the extension unit 30 are in contact with the lower portion 14*d* of the apparatus main body 12 to form the gap GP. That is, the upper case 33 and the upper case 34, upper surfaces of which have the same height, are arranged on the right and left sides of an opening 30*h* through which the inside of the sheet cassette 31 can be visually recognized from the upper side in the extension unit 30 as shown in FIG. 4A. A convexed portion 61 and a convexed portion 62 protruding upward are formed near the handhold configuring portion 33*a* in the horizontal direction (the left direction in this case) and near the handhold configuring portion 34*a* in the horizontal direction (the right direction in this case) in the upper case 33 and the upper case 34, respectively. Similarly, four contact portions 65*a*, 65*b*, 65*c*, and 65*d* which are brought to be in contact with the lower surface of the lower portion 14*d* of the device case 14 in the apparatus main body 12 are formed in a distributed manner in the extension unit 30. In addition, the contact portion 65*d* has an oval contact surface while the other contact portions 65*a*, 65*b*, and 65*c* have circular contact surfaces.

According to this embodiment, the contact portions 65*b* and 65*c* are integrally formed with the lower case 32 so as to project upward by predetermined amounts from the upper surface of the upper case 33 via through-holes formed in the right upper case 33 individually corresponding to the contact portions 65*b* and 65*c*, which are not shown in the drawing. In addition, the contact portions 65*a* and 65*d* are integrally formed with the lower case 32 so as to protrude upward by predetermined amounts from the upper surface of the upper case 34 via through-holes formed in the left upper cases 34 individually corresponding to the contact portions 65*a* and 65*d*, which are not shown in the drawing.

That is, the contact portion 65*c* (65*a*, 65*b*, 65*d*) is formed so as to project upward up to a position which is higher than the upper surface of the upper case 33 (34) as shown in FIG. 4B. In addition, the convexed portion 61 (62) is inserted and fitted into the concaved portion 16*a* (16*b*) provided in the lower portion 14*d* of the device case 14 of the apparatus main body 12 individually corresponding to the convexed portion 61 (62). Fitting in this embodiment includes a state where the apparatus main body 12 has an enough gap with respect to the extension unit 30 between the convexed portion 61 (62) and the concaved portion 16*a* (16*b*) to allow relative displacement in the horizontal direction within a range in which recording processing on the sheet P is not disturbed in the recording apparatus 11.

The contact portion 65*c* (65*a*, 65*b*, 65*d*) functions as a gap forming member in a state where the convexed portion 61 (62) is fitted into the concaved portion 16*a* (16*b*) as described above to form the gap GP between the lower portion 14*d* of the apparatus main body 12 and the upper portion of the upper case 33 (34). The contact portions 65*a*, 65*b*, 65*c*, and 65*d* are formed with a material (such as ABS resin) with high rigidity exhibiting smaller compressional deformation amount than that of the main body legs 69.

According to this embodiment, retracting portions 39 which retract so as not to bring the main body legs 69 into contact with the extension unit 30 (upper cases 33 and 34) (that is, the main body legs are in a non-contact state) in a state where the contact portion 65*c* (65*a*, 65*b*, 65*d*) are in contact with the lower surface of the lower portion 14*d* are provided in a concaved manner in the upper surface of the upper cases 33 and 34. Three retracting portions 39 are respectively provided in the upper cases 33 and 34 corresponding to the main body legs 69. According to this embodiment, the contact portions 65*a*, 65*b*, 65*c*, and 65*d* in the extension unit 30 are provided at positions in the horizontal directions from the main body legs 69 or in the vicinities thereof when the extension unit 30 is attached to the apparatus main body 12. For this reason, the retracting portions 39 provided so as to correspond to the positions of the main body legs 69 are positioned in the vicinities of the contact portions 65*a*, 65*b*, 65*c*, and 65*d* in the horizontal directions.

An action in the recording apparatus 11 with the above configuration, namely an action of causing external air which is relatively cooler than the warmed air to flow into the recording unit 20 in the apparatus main body 12 from the outside of the apparatus main body 12 as the air warmed in the recording unit 20 rises will be described with reference to FIG. 5.

Figure 5:
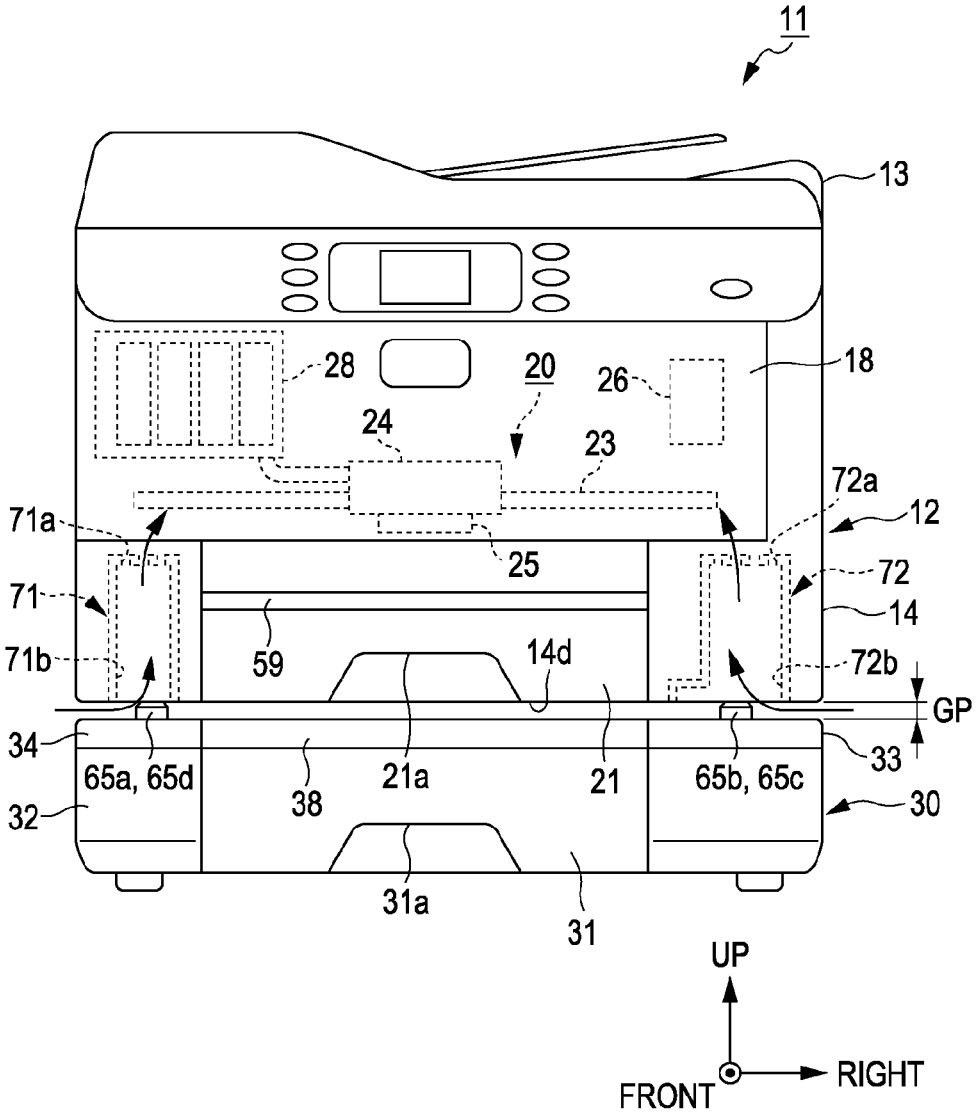
FIG. 5 is a front view of the recording apparatus in a state where external air flows thereinto via a duct of the apparatus main body.

As shown in FIG. 5, the contact portions 65*b* and 65*c* form the gap GP at least between the right upper case 33 and the apparatus main body 12 in the recording apparatus 11 (lower portion 14*d*) in the state where the apparatus main body 12 is placed on the extension unit 30. In addition, the contact portions 65*a* and 65*d* form the gap GP at least between the left upper case 34 and the apparatus main body 12 (lower portion 14*d*). Accordingly, the external air flowing from the gaps GP flows into the recording unit 20 through the ducts 71 and 72 as the air warmed in the recording unit 20 rises.

The external air flowing from the gap GP formed on the right side of the recording apparatus 11 into the gap between the apparatus main body 12 and the extension unit 30 flows into the duct line of the duct 72 from the lower opening 72*b* of the duct 72 in communication with the lower space of the lower portion 14*d* of the apparatus main body 12, rises therefrom, passes through the upper opening 72*a*, and flows into a space where the recording unit 20 is disposed (arrows in the drawing). The flowing external air cools the substrate unit 26 disposed in the upper vicinity of the upper opening 72*a* and the liquid ejecting head 25 displacing on the right side.

Alternatively, the external air flowing from the gap GP formed on the left side of the recording apparatus 11 into the space between the apparatus main body 12 and the extension unit 30 flows into the duct 71 from the lower opening 71*b* of the duct 71 communicating with the lower space of the lower portion 14*d* of the apparatus main body 12, rises therefrom, further passes through the upper opening 71*a*, and flows into the space where the recording unit 20 is disposed (arrows in the drawing). The flowing external air cools the cartridge holder 28 disposed near the upper portion of the upper opening 71*a* and the liquid ejecting head 25 displacing on the left side. In addition, the air warmed in the recording unit 20 is discharged to the outside of the apparatus main body 12 through the gap such as a case attachment portion or the transport path provided in the device vase 14 or an exhaust port provided in the device case 14.

According to the above embodiment, the following effects can be achieved.

(1) when the extension unit 30 is attached to the apparatus main body 12, the gap GP for which the contact portions 65*a*, 65*b*, 65*c*, and 65*d* with high rigidity suppress the decrease in clearance due to change over time is stably formed between the lower portion 14*d* of the apparatus main body 12 and the extension unit 30. Accordingly, the external air reliably flows into the apparatus main body 12 from the lower portion 14*d* of the apparatus main body 12. In addition, when the sheet P contained in the sheet cassette 31 of the extension unit 30 is transported to the recording unit 20, the length of the transport path for the sheet P sent to the transport path (transport passage 55) in the apparatus main body 12 is suppressed not to be shorten. Accordingly, the variation in the transport conditions is avoided, and the sheet P is stably transported along the transport path.

(2) Since the contact portions 65*a*, 65*b*, 65*c*, and 65*d* and the retracting portions 39 make it possible to reliably maintain a state where the main body legs 69 are not in contact with the extension unit 30, it is possible to suppress the crush due to the compression by the main body legs 69. Accordingly, the decrease in the gap between the lower portion 14*d* and the placement surface T is suppressed in a state the extension unit 30 is detached later and the apparatus main body 12 is placed on the placement surface T.

(3) The external air flowing into the apparatus main body 12 from the lower portion 14*d* makes it possible to effectively suppress temperature rise in the recording unit 20.

In addition, the above embodiment can be modified as follows.

In the above embodiment, the extension unit 30 is provided with a duct including one opening at a part facing the lower portion 14*d* when attached to the apparatus main body 12 and the other opening at a part other than the facing part. This modified example will be described with reference to FIGS. 6A and 6B. In addition, same reference numerals will be given to the same functional elements as those in the above embodiment, and the description thereof will be omitted.

Figure 6A:
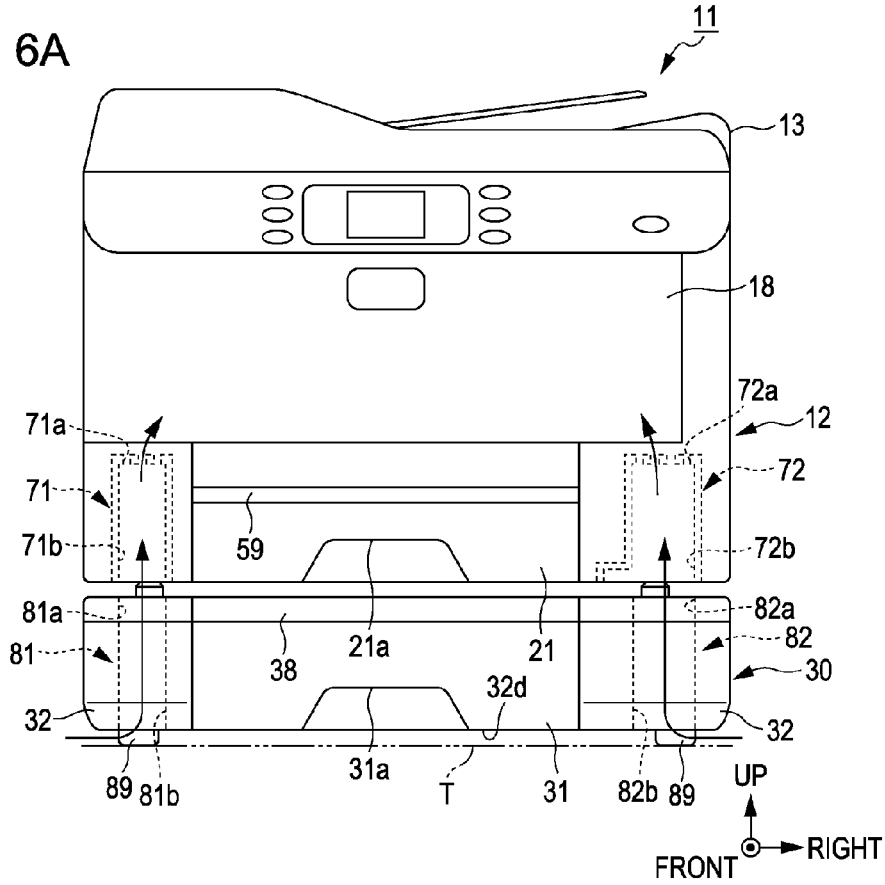
FIGS. 6A and 6B are configuration diagrams of a duct provided in the extension unit according to modified examples.

As shown in FIG. 6A, the extension unit 30 is provided with a duct 81 on the left side and a duct 82 on the right side, respectively in this modified example. That is, the duct 81 is provided with an upper opening 81*a* as one opening at the upper portion of the extension unit 30 at a part facing the lower portion 14*d* and is formed so as to communicate with the gap between the apparatus main body 12 and the extension unit 30. On this occasion, the upper opening 81*a* may be formed such that at least a part thereof overlaps the lower opening 71*b* of the duct 71 in the vertical direction. On the other hand, a lower opening 81*b* as the other opening is provided in the lower portion 32*d* as a part other than the upper portion of the extension unit 30 and is formed so as to communicate with the gap formed by the unit legs 89 between the lower portion 32*d* of the extension unit 30 and the placement surface T.

Similarly, the duct 82 is provided with an upper opening 82*a* as one opening on the upper surface of the upper portion of the extension unit 30 and is formed so as to communicate with the gap between the apparatus main body 12 and the extension unit 30. On this occasion, the upper opening 82*a* may be formed such that at least a part thereof overlaps the lower opening 72*b* of the duct 72 in the vertical direction. On the other hand, a lower opening 82*b* as the other opening, is provided in the lower portion 32*d* of the extension unit 30 in the same manner as in the lower opening 81*b* and is formed so as to communicate with the gap (space) formed by the unit legs 89 between the lower portion 32*d* of the extension unit 30 and the placement surface T.

As a result, the external air flows into the gap between the extension unit 30 and the placement surface T as well as the gap between the apparatus main body 12 and the extension unit 30. Accordingly, the external air acts as shown in the arrows in FIG. 6A so as to flow into the apparatus main body 12 from the lower portion 32*d* of the extension unit 30.

Figure 6B:
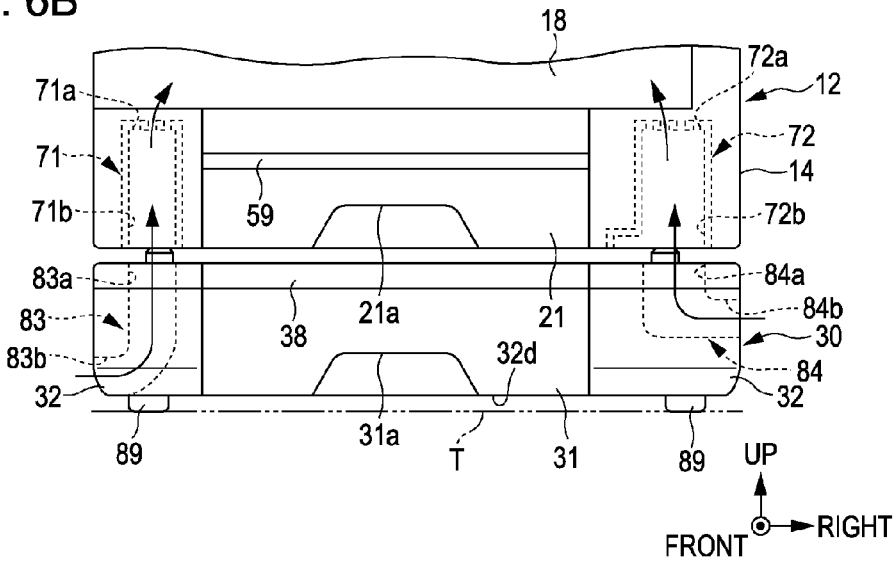

Alternatively, the extension unit 30 may be provided with a duct 83 and a duct 84 with duct lines curved in the course thereof on the left side and the right side, respectively as shown in FIG. 6B.

That is, an upper opening 83*a* as one opening is formed so as to communicate with the gap between the apparatus main body 12 and the extension unit 30 for the duct 83. On this occasion, the upper opening 83*a* may be formed such that at least a part thereof overlaps the lower opening 71*b* of the duct 71 in the vertical direction. On the other hand, a lower opening 83*b* as the other opening is formed at the lower end portion of the left side surface of the lower case 32 in the extension unit 30. On this occasion, the lower opening 83*b* may be formed so as to communicate with the handhold configuring portion 32*a* (see FIG. 1) provided in the lower portion 32*d* of the extension unit 30.

Similarly, an upper opening 84*a* as one opening is formed so as to communicate with the gap between the apparatus main body 12 and the extension unit 30 for the duct 84. On this occasion, the upper opening 84*a* may be formed such that at least a part thereof overlaps the lower opening 72*b* of the duct 72 in the vertical direction. On the other hand, a lower opening 84*b* as the other opening is formed as the center of the right side surface of the lower case 32 in the extension unit 30.

As a result, the external air acts as shown by the arrows in FIG. 6B so as to flow into the apparatus main body 12 from the side surface of the extension unit 30 as well as the gap between the apparatus main body 12 and the extension unit 30. It is a matter of course that the lower openings 83*b* and 84*b* may be formed at any positions in the side surfaces of the lower case 32.

According to the modified examples, the following effect can be achieved in addition to the effects (1) to (3) achieved in the above embodiment.

(4) Since the external air can be caused to flow into the lower portion 14*d* of the apparatus main body 12 from the side of the extension unit 30 in a state where the extension unit 30 is attached to the apparatus main body 12, the total amount of the external air flowing into the lower portion 14*d* of the apparatus main body 12 increases.

In the above embodiment, it is preferable that the gap GP be formed between the lower portion 14*d* of the apparatus main body 12 and the extension unit 30 around the entire circumference of the lower portion 14*d* in a state where the extension unit 30 is attached to the apparatus main body 12. That is, the positions of the upper surfaces of the upper case 38, the fixed frame 37, and the lower case 32 are formed so as not to be higher than the upper positions of the upper cases 33 and 34 (see FIG. 4A).

According to the modified examples, the following effect can be achieved in addition to the effects (1) to (3) achieved in the above embodiment.

(5) Since the total amount of the external air flowing into the lower portion 14*d* of the apparatus main body 12 increases, the external air reliably flows into the apparatus main body 12 from the lower portion 14*d* of the apparatus main body 12.

In the above embodiment, the lower opening 71*b* of the duct 71 may be formed so as to communicate with the handhold configuring portion 14*a*. Similarly, the lower opening 72*b* of the duct 72 may be formed so as to communicate with the handhold configuring portion 14*b*. In so doing, more external air can be caused to flow into the lower portion 14*d* via the spatial regions of the handhold configuring portions 14*a* and 14*b*.

In the above embodiment, it is not necessary that the ducts 71 and 72 are provided with upper openings 71*a* and 72*a* so as to overlap the lower openings 71*b* and 72*b* in the vertical direction. For example, no problem occurs if the upper opening 72*a* is positioned on the lower side of the substrate unit 26 in the vertical direction and deviated from the position corresponding to the lower opening 72*b* in the vertical direction in order to effectively air-cool the substrate unit 26. It is a matter of fact that the lower opening 72*b* and the upper opening 72*a* may be caused to communicate with each other by bending the duct line in this case.

In the above embodiment, it is not necessary that the ducts 71 and 72 communicating with the recording unit 20 from the lower portion 14*d* are formed in the apparatus main body 12. If the external air flowing into the gap GP through the gap of the device case 14, the transport path, and the like other than the ducts 71 and 72 flows into the apparatus main body 12, it is not necessary to provide the ducts 71 and 72.

In the above embodiment, it is not necessary to arrange the main body legs 69 so as to be adjacent to the contact portions 65*a*, 65*b*, 65*c*, and 65*d* in the horizontal direction. When the lower portion 14*d* is less deformed (bent backward) or when the retracting portions 39 can be formed with large (deep) sizes in the upper cases 33 and 34 in the extension unit 30, such a configuration can be employed.

In the above embodiment, the main body legs 69 of the apparatus main body 12 and the unit legs 89 of the extension unit 30 may be made of a same material. In so doing, it is possible to commonly use the main body legs 69 and the unit legs 89, and it is possible to suppress the increase in kinds of members.

In the above embodiment, the medium is not limited to the sheet P, and a plate-shaped member made of a metal plate, a resin plate, a cloth, or the like may be used. That is, any member can be employed as the medium as long as the member can be transported.

In the above embodiment, the recording unit 20 may be an on-carriage type according to which the ink cartridge 27 is mounted on the carriage 24. Alternatively, the invention is not limited to a serial type printer according to which the carriage 24 is displaced in the main scanning direction and may be applied to a line-head type printer capable of printing characters in a range up to a sheet maximum width while the liquid ejecting head 25 is fixed.

In the above embodiment, the recording apparatus 11 may be an apparatus which does not include the image reading unit 13, or may be a multifunction machine provided with functions of a facsimile, a copy machine, and the like as well as the recording unit 20. In addition, the recording apparatus 11 may be an apparatus which does not include the reversing unit 50 and performs recording only on one side of the sheet P.

Although the invention was implemented as a liquid ejecting device which causes the recording unit 20 in the recording apparatus 11 to function as an ink-jet printer for ejecting ink as liquid in the above embodiment, the invention may be implemented as a liquid ejecting device which causes the recording unit 20 to ejects and discharges liquid other than ink. Various liquid ejecting devices each provided with a liquid ejecting head and the like for discharging a significantly small amount of liquid droplets may be used instead. In addition, the liquid droplets mean a state of liquid discharged from the liquid ejecting device and include granular droplets, tear-shaped droplets, and droplets with threadlike tails. In addition, the liquid described herein may be a material which can be ejected by the liquid ejecting device. For example, the liquid may be a substance in a liquid phase, fluid such as a liquid state substance with a high or low viscosity, sol, gel water, other inorganic solvent medium, organic solvent medium, solution, liquid resin, liquid metal (metallic melt), and the liquid is not limited to liquid as one state of a substance and includes solvent containing solid functional material such as pigment or metallic particles resolved and dispersed therein. Representative examples of the liquid include ink as described in the above embodiment, liquid crystal, and the like. Here, ink includes various liquid compositions such as general water-based ink, oil-based ink, gel ink, hot-melt ink, and the like. As a specific example of the liquid ejecting device, a liquid ejecting device can be exemplified which eject ink containing a material such as an electrode material, a colorant, or the like used in manufacturing a liquid crystal display, an EL (Electroluminescent) display, a surface-emitting display, or a color filter dispersed or resolved therein. Alternatively, a liquid ejecting device which ejects bioorganic substance to be used in manufacturing a biochip, a liquid ejecting device which is used as a precision pipette and ejects liquid as a sample, a textile printing device, a micro-dispenser and the like can be exemplified. Furthermore, a liquid ejecting device which exactly ejects lubricant oil to precision equipment such as a watch, a camera, or the like, a liquid ejecting device which ejects transparent resin liquid such as ultraviolet curable resin or the like onto a substrate to form a fine semi-sphere lens (optical lens) used in an optical communication element, a liquid ejecting device which ejects acid or alkaline etching liquid to etch a substrate or the like may be employed. In addition, the invention can be applied to any one of the above liquid ejecting devices.

The entire disclosure of Japanese Patent Application No. 2011-184952, filed Aug. 26, 2011 is expressly incorporated by reference herein.

What is claimed is:

1. A recording apparatus comprising:

an apparatus main body provided with a recording unit which performs recording on a recording medium;

an extension unit provided with a containing unit of the recording medium, which is detachably attached to a lower portion of the apparatus main body on a side of a weight direction of the apparatus main body;

main body legs which are provided on the lower portion of the apparatus main body and are in contact with a placement surface when the apparatus main body is placed on the placement surface; and gap forming members which are provided in the extension unit, have higher rigidity exhibiting less compressional deformation as compared with the main body legs, and form a gap between the lower portion of the apparatus main body and the extension unit while being in contact with the lower portion of the apparatus main body, wherein the main body legs of the apparatus main body are in a non-contact state with respect to the extension unit, wherein the apparatus main body includes ducts formed at the lower portion so as to communicate with inside of the apparatus main body.

2. The recording apparatus according to claim 1, wherein the extension unit includes retracting portions, by which the main body legs are brought to be in the non-contact state with respect to the extension unit, at parts corresponding to the main body legs of the apparatus main body.

3. The recording apparatus according to claim 1, wherein the apparatus main body includes a placement portion on which the recording medium is placed, and wherein the ducts provided in the apparatus main body are formed at both sides of the placement portion.

4. The recording apparatus according to claim 1, wherein the extension unit is provided with a duct including one opening at a facing part facing the lower portion of the apparatus main body and the other opening at a part other than the facing part.

* * * * *